US009103634B2

(12) United States Patent
Lee

(10) Patent No.: US 9,103,634 B2
(45) Date of Patent: Aug. 11, 2015

(54) PORTABLE SHIELDING DEVICE

(71) Applicant: Jen-Feng Lee, Hacienda Heights, CA (US)

(72) Inventor: Jen-Feng Lee, Hacienda Heights, CA (US)

( * ) Notice: Subject to any disclaimer, the term of this patent is extended or adjusted under 35 U.S.C. 154(b) by 0 days.

(21) Appl. No.: 13/754,564

(22) Filed: Jan. 30, 2013

(65) Prior Publication Data

US 2014/0208932 A1 Jul. 31, 2014

(51) Int. Cl.
*F41H 5/013* (2006.01)
*F41H 5/06* (2006.01)

(52) U.S. Cl.
CPC . *F41H 5/06* (2013.01); *F41H 5/013* (2013.01)

(58) Field of Classification Search
CPC ..... F41H 5/013; F41H 5/08; F41H 5/14; F41H 5/18; F41H 5/24; F41H 5/06
USPC ..... 89/36.09, 36.07, 919, 920, 926, 927, 89/929, 937
See application file for complete search history.

(56) References Cited

U.S. PATENT DOCUMENTS 1,385,371 A * 7/1921 Fraser ..... 2/2.5
2,306,708 A * 12/1942 Mendel ..... 42/106
2008/0121100 A1* 5/2008 Pastrnak et al. ..... 89/36.09

* cited by examiner

*Primary Examiner* — Stephen M Johnson
(74) *Attorney, Agent, or Firm* — Jen-Feng Lee, Esq.

(57) ABSTRACT

Present invention teaches a foldable multi-pan shielding device consisting of a number of connected rigid planar pieces that can be easily deployed when drawn out and set up in a corner of a room or a classroom; a protrusion mechanism in between two connected straight pieces will create a small angle when clicked into place, providing a bow-like tensioning structure and a "pie" safety zone to be formed when the two side pieces are engaged to the walls.

5 Claims, 15 Drawing Sheets

17A

17B

17C

17D

PORTABLE SHIELDING DEVICE

FIELD AND BACKGROUND OF THE INVENTION

The present invention relates generally to a foldable and easy-to-deploy shielding device, for creating a temporary protecting shield or screen, during emergency situations.

Particularly, present invention provides for an easily retracted/folded and easily deployed/drawn-out shielding device that takes up little space when put away. When deployed, it can create a screened-off "pie"-shaped safety zone for temporary protection and resistance against incoming projectiles or bullets, benefitting some fifteen adults or twenty-five school children of normal sizes, according to the sample 6-piece 3×5 (foot) disclosure discussed herein.

To deploy the shielding device from its retracted state where all straight rigid planar pieces are generally kept in a parallel manner, a person can simply "draw" out the rigid planar pieces, which are slidably connected together in a seriatim manner.

Also, the rigid planar pieces are slidably engaged by a track formation that generally maintains these straight pieces in a parallel fashion, both in the "stored" stated and in the "deployed" state.

For straight shaped rigid planar pieces, a small angle will be created between every two connected pieces, so as to from an overall arc-shaped "pie" screen.

A preferred embodiment would have a pop-out ball structure clicking into a receiving cavity, when all the planar pieces are drawn laterally to a pre-set position relative to the one connected, forming a temporary safe "pie" area when engaged to two side walls, 90-degrees for example.

Alternatively, a travel limiter means on the track formation will create a small overlapping segment between two adjacent rigid planar pieces. A small angle will be formed thereto between two straight pieces, which provides the bow-tensioning force for the overall deployed shielding device.

For the slightly curved version of the rigid planar pieces, the angles of the overall "bow" shape will be defined by the natural arc angles of all the deployed rigid planar pieces, having a small overlapping segment between any two pieces.

OBJECTS AND SUMMARY OF THE INVENTION

Present invention teaches to build an easy-to-use and easy-to-store, foldable projectile-resisting multi-pane shield that can be deployed within seconds, to provide for emergency protection from dangerous objects such as bullets discharged from guns, or similar weapons.

The invention disclosed herein comprises of a plurality of rigid planar pieces serially connected together. As such, when the rigid planar pieces are folded up (retracted) for storing away, the shield looks a like a travel suit case and is easy to handle or kept/store away.

At deployed state, the shield looks like a multiple-pane screen and is generally self-standing, with optional hooking mechanisms on right and left sides for engaging to adjacent structures, such as walls.

Between every two serially connected rigid planar pieces, an extended screen area can be formed by moving them laterally, referred to as "drawn out" in the sample disclosure herein.

To form a small angle between two adjacent rigid planar pieces, a pop out ball structure on one rigid planar piece clicks into a corresponding receiving cavity on an adjacent rigid planar piece, the lateral (drawn) movement stops and a small segment of overlapping area is formed. This small segment of overlapping area creates a bow-like tensioning force to support the multiple-pane screen structure to withstand oncoming impact force, such as bullets or other dangerous projectiles.

The formation of a small angle in the short overlapping segment between two rigid planar pieces can also be done by an inset notch on one end of a rigid planar piece, while the adjacent drawn out piece's "tail" end will mesh into this angled notch, to form the desired small angle.

Alternatively, each of said rigid planar pieces may be of a slight arc-shape, from a top-down orientation view. As such, when these serially-connected rigid planar pieces are drawn out to deploy into a protective screen, a longer arc-shape will be formed, with travel limiter means to maintain a small overlapping segment between every two adjacent rigid planar pieces. This small overlapping segment serves to create the bow-like tensioning force, when the deployed screen is set against two side structures, two walls in the corner of a class room, for example.

The rigid planar pieces can be made of metal, hard plastic, or other composite materials suitable for the projectile-resisting purpose or bullet-resisting purpose. The commercially available Kevlar material, or other new and to-be-developed materials can all be used to construct the shield of present invention.

Optionally, the rigid planar piece can be made from a rigid frame having a central opening area that is covered by appropriate fabric-like material, which can also be made from similar Kevlar or other suitable composite materials.

With the layer(s) of said sturdy fabric-like material fixed to the rigid frame, there is an inherent "wiggle" effect, when a projectile hits, similar to a golf ball hitting a net or a cloth hanging in mid-air, and is conducive to reducing the impact power produced by a fast-traveling projectile.

Depending on the desired implementation, two or more layers of said sturdy flexible fabric-materials may be fixed to said rigid frame, for better protective.

Optionally, a frame center row can be built to said rigid frame.

The pop out ball structure, the receiving cavity and other relevant "clicking" and protrusion mechanism, detailed later, can either set to form on the top, or down portion of said rigid frame, or the center frame row.

In a sample 6-piece construction, as further discussed in later paragraphs, each rigid planar piece may have a sample 2-D size of about 3-foot by 5-foot (3-foot wide and 5-foot tall). For an exemplary construction of a sample 6-piece device herein, we can choose a small overlapping segment (between every two connected rigid planar pieces) about six (6) inches. As such, said sample 6-piece shield will have a roughly 15.5 foot long (6 times 3, minus the 5 segments of 0.5 foot overlaps) and 5-foot high protective "wall", when deployed.

If the sample 6-piece shielding device of the present invention is deployed in a room corner, having 90-degree walls flanking on two sides, the "pie" area created by the 15.5-foot shield will have a radius of roughly 9.5 feet, and an area of roughly 70 square feet. This "pie" area will be generally sufficient for some 25 school children or 15 people of normal size to stay down close together (under the proposed 5-foot shield wall) for a short while during an emergency.

The actual dimensions or sizes of these rigid planar pieces are not limited by the samples given herein. Other sizes can certainly be chosen for implementation.

DESCRIPTION OF THE DRAWINGS

The accompanying drawings, which are incorporated in and constitute a part of this specification, illustrate the preferred embodiments of the invention and together with the description, serve to explain the principles of the invention.

A brief description of the drawings is as follows:

FIG. 3A is a side (horizontal) view of the protrusion means implemented by a block piece with an angle peg. The dotted arrow shows the direction of the block piece movement, at the time when the pop out ball structure is clicked in.

FIGS. 16 A/B show a simplified view of the travel limiter means of a C track formation (without the loop fitting piece, for ease of understanding), using stopper peg and close-end block.

DETAILED DESCRIPTION OF THE PREFERRED EMBODIMENT

As shown herein, the preferred embodiment of present invention includes a projectile-deflecting/resisting shielding device 10 that is generally formed by a plurality of connected rigid planar pieces 100.

The shielding device 10 can be easily folded up into a "travel case" type configuration, making it easy for storing away, or for keeping to the sidewall of a housing structure, such as a classroom wall.

Figure 1A:
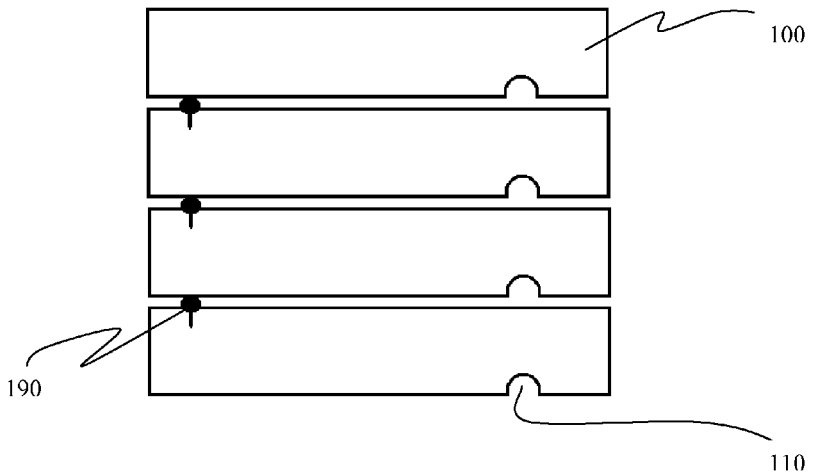
FIG. 1A is a top-down view for the shielding device of the present invention, in a folded up state.

FIG. 1A shows the top-down view of the shielding device when the rigid planar pieces 100 are in a "stored" state.

In the disclosure herein as shown in FIG. 1A, the bottom rigid planar piece 100 will be the right-most piece, and will be drawn to the right when it is being deployed for use. The top rigid planar piece 100 will be the left-most piece, consequently. Persons reasonably skilled in the art would not need any more disclosure, if a left-right reverse construction is needed, as the mechanism and function will be equivalent.

Figure 1B:
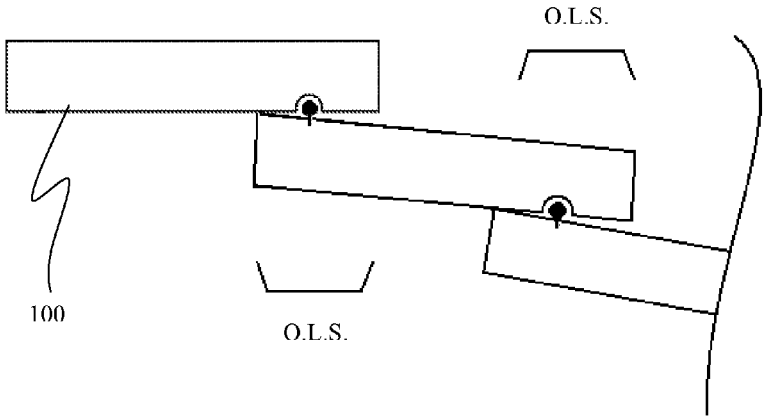
FIG. 1B is a top-down view for the shielding device, showing the rigid planar pieces are being drawn out for deployment and the pop out ball structures are clicking into a corresponding receiving cavity of an adjacent rigid planar piece.

FIG. 1B shows the shielding device 10 is being drawn out to a "deployed" state.

In this sample disclosure, the bottom piece 100 in FIG. 1A of the shielding device 10 is being drawn out towards the right side.

When the rigid planar pieces 100 are drawn out (for deployment), there will be a small overlapping segment between every two adjacent rigid planar pieces, denoted as O.L.S. on FIG. 1B.

Figure 8A:
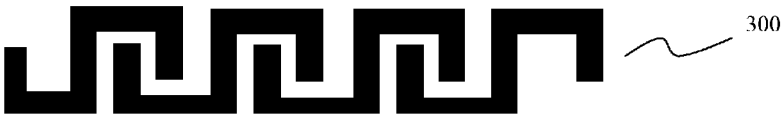
FIGS. 8A and 8B show the overlapping track formation, in a side horizontal view manner, to allow the adjacent rigid planar pieces to have slidable engagement with each other.
Figure 8B:
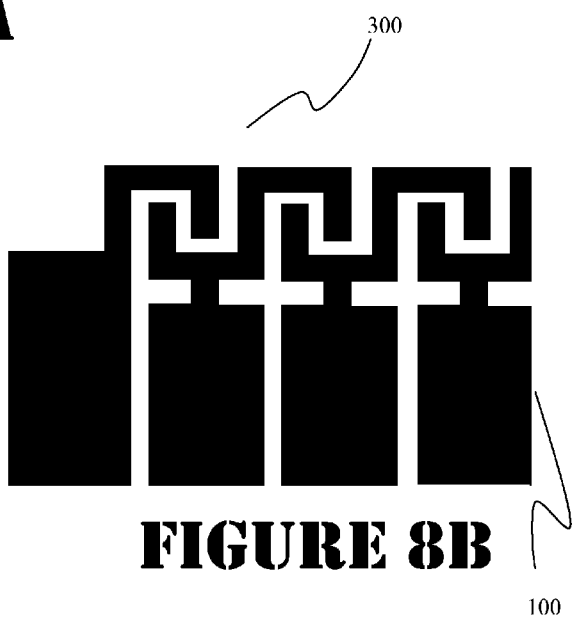

The rigid planar pieces 100 of present shielding device 10 are connected in a seriatim fashion. The connection between any two adjacent rigid planar pieces 100 may be made by slidable track formation 350, such as overlapping track formation 300 in FIGS. 8A and 8B.

Figure 9:
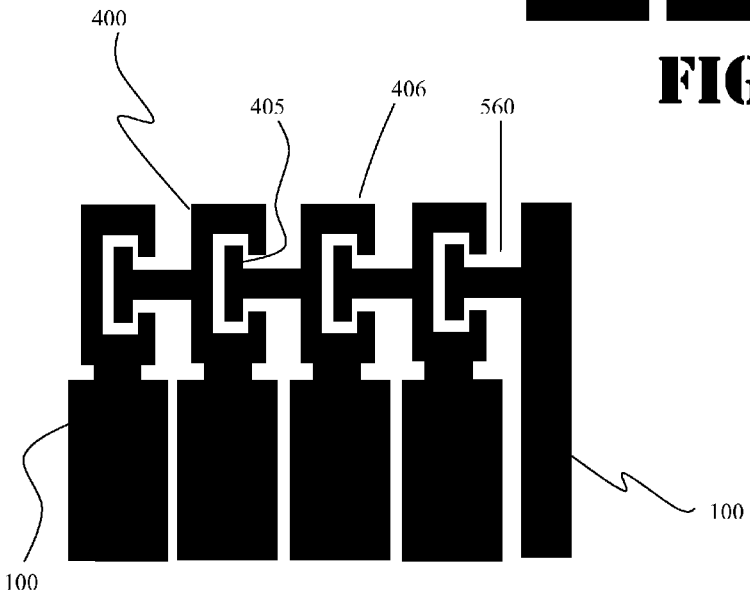
FIG. 9 shows, in a side horizontal view manner, the C track formation, to allow the adjacent rigid planar pieces to have slidable engagement with each other.

Alternatively, the slidable track arrangement can be in the form of a C track formation 400, as shown in FIG. 9, which is a side (lateral) view showing the plurality of rigid planar pieces 100 next to one another.

The C-shaped outside loop 406 runs generally along the lateral of the rigid planar piece 100. On the "back side" of said outside loop 406, a loop fitting piece 560 extends out towards the "opening" of the next C outside loop and ends with an inside track 405 portion that travels inside the space of said next outside loop 406. See FIGS. 9, 16A, 16A-2, 16B and 16B-2.

The track formation 350 can be made either on top of the rigid planar pieces 100, or at the bottom, or both locations.

Figure 6A:
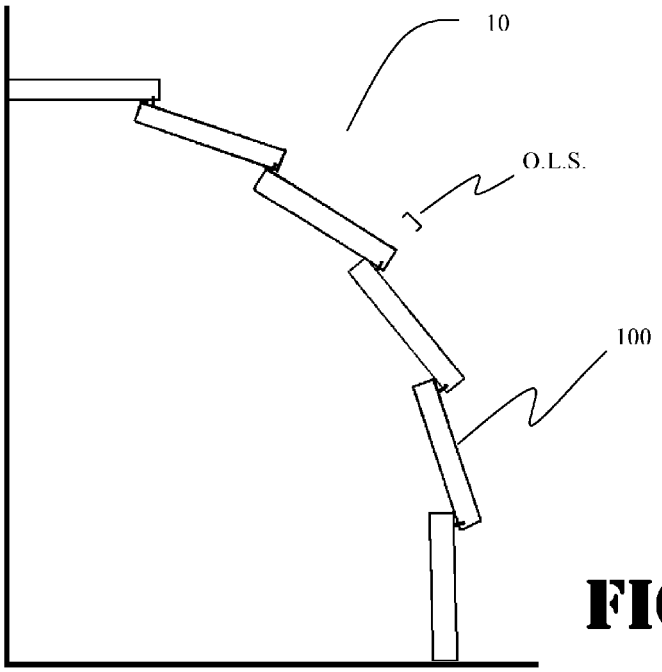
FIG. 6A shows the shielding device of present invention in a deployed state, viewed in a top-down manner.

To create an arc-shaped overall screen from the constituent straight rigid planar pieces 100, a small angle must be created by a protrusion means 103 on the small overlapping segment O.L.S. between two adjacent rigid planar pieces 100, as shown in FIG. 6A.

In a standing position of a deployed shield device 10, the "protrusion means" 103 and the "clicking" into said cavity 110 happens on a generally horizontal orientation, as the figures show and discussed herein.

A first embodiment of said protrusion means 103 is a pop out ball structure 190 on one rigid planar piece 100 that "clicks" into a corresponding receiving cavity 110 of the other rigid planar piece 100, when drawn to move laterally, with a small O.L.S length, as shown in FIG. 1B.

The "clicking" of said ball structure 190 to said corresponding receiving cavity 110 will stop further lateral movement of the drawn rigid planar piece 100, and set the two adjacent rigid planar pieces 100 in pre-determined relative angled position.

The track formation 350 causes the rigid planar pieces 100 to stay generally in a parallel manner among them. However, the track formation 350 will also have some wiggle or play room, so that any two adjacent rigid planar pieces 100 may be placed at a slight non-parallel angle when drawn out, as effected by the protrusion means 103.

Figure 4A:
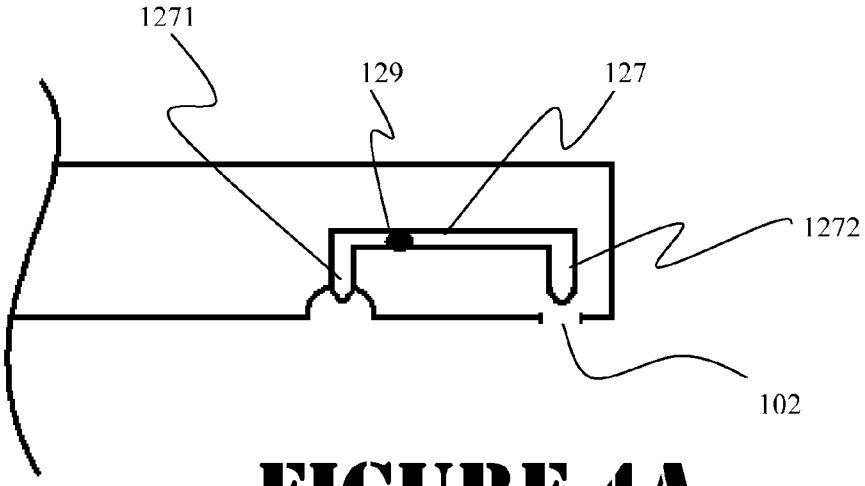
FIG. 4A is a top-down view of a portion of a rigid planar piece, having its protrusion means implemented by a pivoting rod.

The protrusion means 103 is actuated by the pop out ball structure 190 when clicking into the receiving cavity 110 on the adjacent rigid planar piece 100. Said protrusion means 103 can be implemented by a pivoting rod 127, having a pivoting point 129, as shown in FIG. 4A, which is a top-down view of a portion of a rigid planar piece 100.

When the pop out ball structure 190 is "clicked" into the receiving cavity 110, a first end 1271 of said pivoting rod 127 gets pushed in, and a second end 1272 gets pushed out from a side angle hole 102 of the vertical surface of a rigid planar piece 100.

Figure 4B:
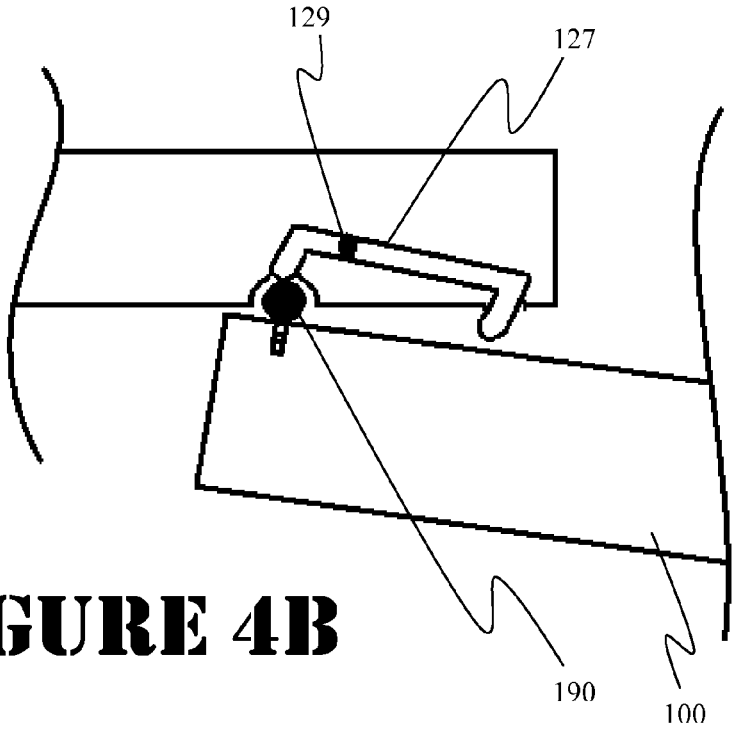
FIG. 4B shows, in the same top-down manner, the pivoting rod is turned an angle and pushing away the adjacent rigid planar piece, when the ball structure of the rigid planar piece clicks into the corresponding receiving cavity.

As shown in FIG. 4B, the pivoting rod 127 rotates horizontally on a pivoting point 129.

As such, said protrusion means 130, as implemented by the pivoting rod 127 will create a small angle in the small overlapping segment O.L.S. between two adjacent rigid planar pieces 100, at time of deployment, as shown in FIG. 6A, which is a top-down view of the shielding device 10.

Alternatively, said protrusion means 103 can be implemented by a block piece 112, which has a front rod 1121 that will enter into the space of the receiving cavity 110. As the side horizontal view shown in FIGS. 3A and 3B, a block spring 1126 will provide the resilient force to maintain said block piece 112 in place, until a pop out ball structure 190 "clicks" into a corresponding receiving cavity 110, and said ball structure 190 then pushes said block piece laterally, so that an angle peg 120 will protrude horizontally through a center hole 1125 of said block piece 112, and will be able to push against an adjacent rigid planar piece 100, to create the small angle, as shown in the deployed view of FIG. 6A.

Figure 3A:
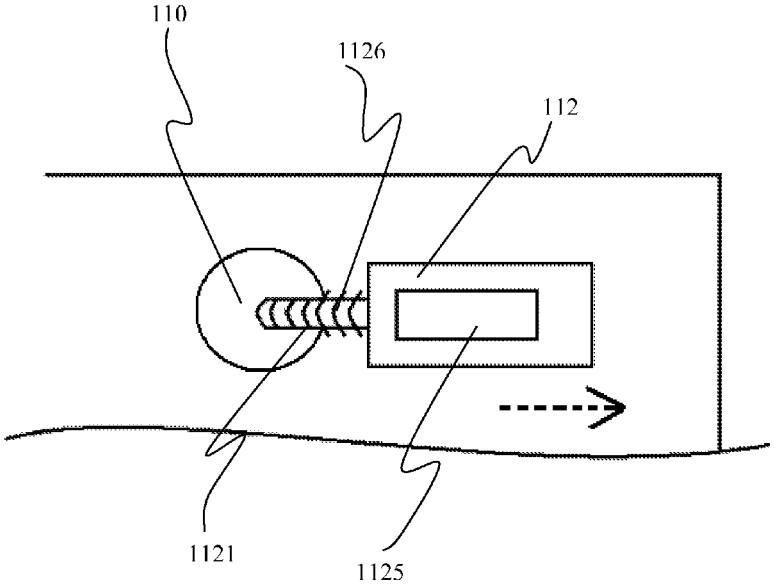
Figure 3B:
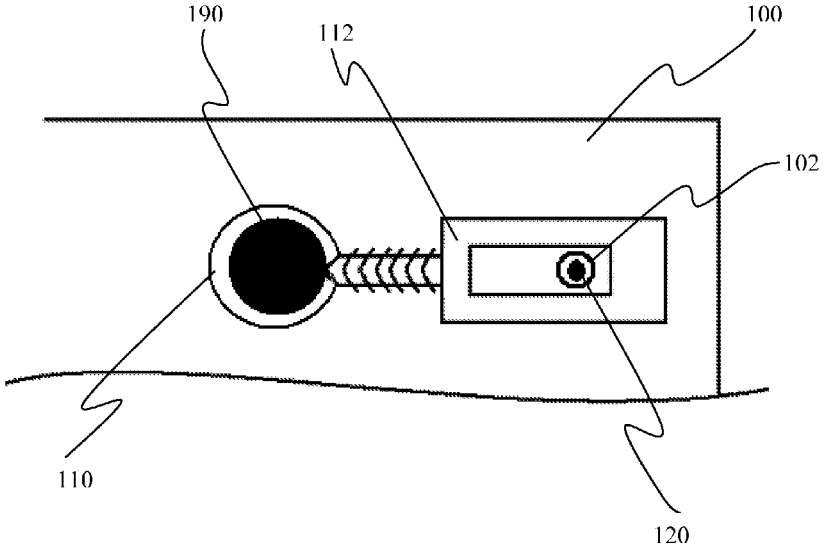
FIG. 3B shows the block piece 112 is pushed inwards, after the ball structure clicks into the receiving cavity.

In FIG. 3A, the angle hole 102 and the angle peg 120 are blocked from view, as the side lateral view presented, by the block piece 112. The angle hole 102 and the angle peg 120 are shown through the center hole 1125, in FIG. 3B.

Figure 2A:
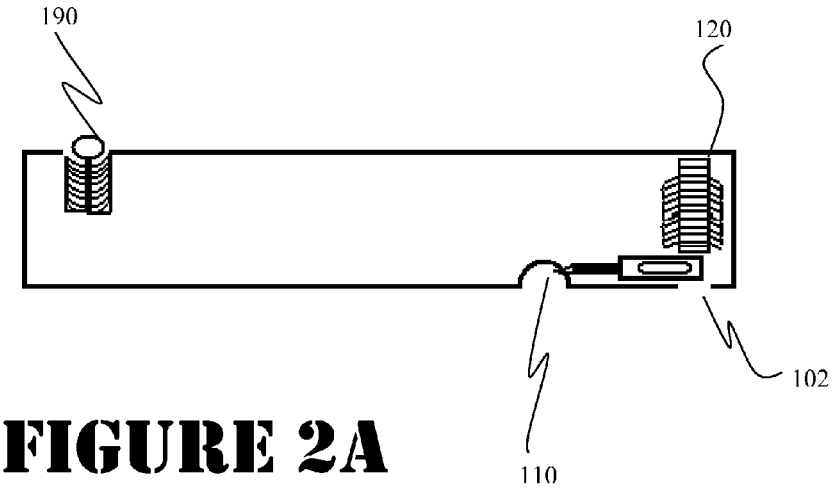
FIG. 2A is a top-down view of a rigid planar piece, having its protrusion means implemented by an angle peg and a block piece.
Figure 2B:
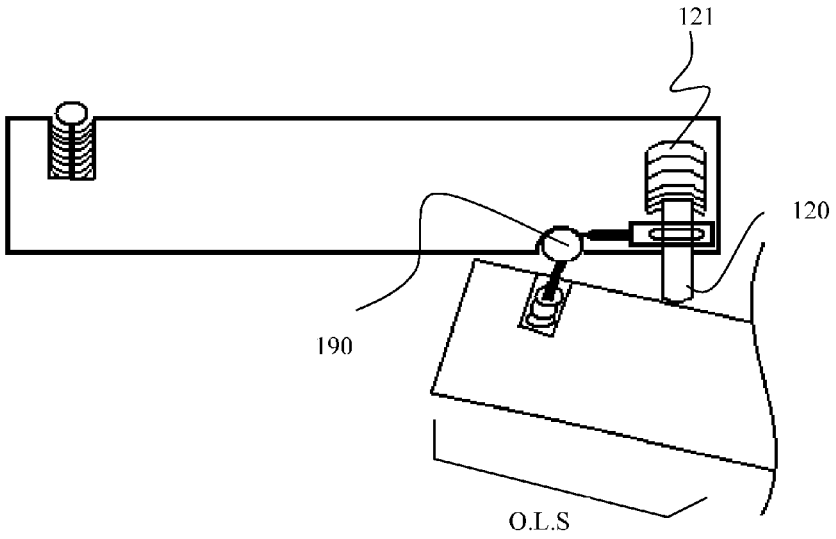
FIG. 2B shows, in the same top-down view manner, the protrusion means of 2A is in a "pushed out" position, creating a small angle between two adjacent rigid planar pieces.

FIGS. 2A and 2B show, in a top-down manner, the protrusion means 103 implemented by said block piece 112, where said angle peg 120, normally retained by peg spring 121, will push out from an angle hole 102 from the vertical side hole (angle hole 102) of a rigid planar piece 100, when a pop out ball structure 190 clicks into a corresponding receiving cavity 110, as shown in FIG. 2B.

Said angel peg 120 will travel through the center hole 1125 of the block piece 112, which is being moved laterally (to the right, as the orientation shown on FIGS. 2B and 3B), and will push against an adjacent rigid planar piece 100 on the O.L.S. (overlapping segment) portion, creating a small angle between the two rigid planar pieces 100.

Figure 5:
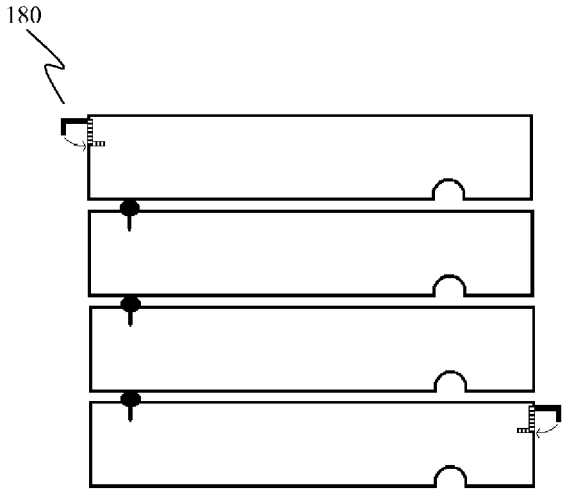
FIG. 5 shows the hooking mechanisms on the left-most (top) piece and the right-most (bottom) piece.
Figure 6B:
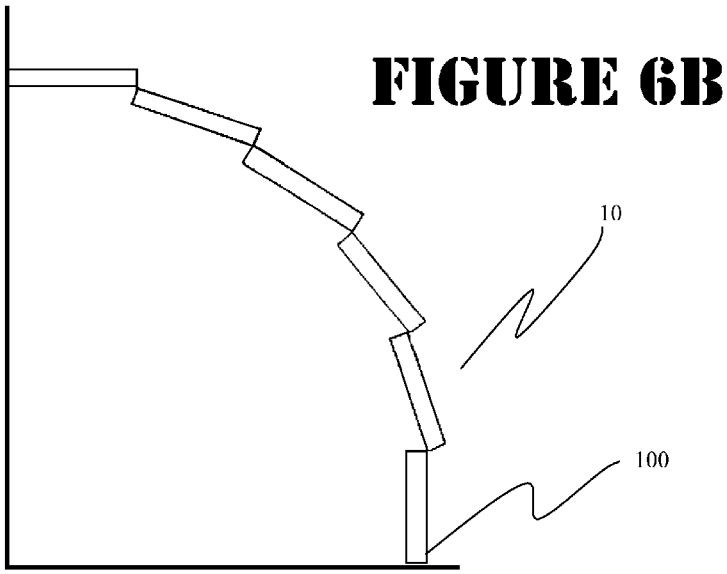
FIG. 6B shows an alternative embodiment of the shielding device without the overlapping segment between every two pieces.
Figure 7:
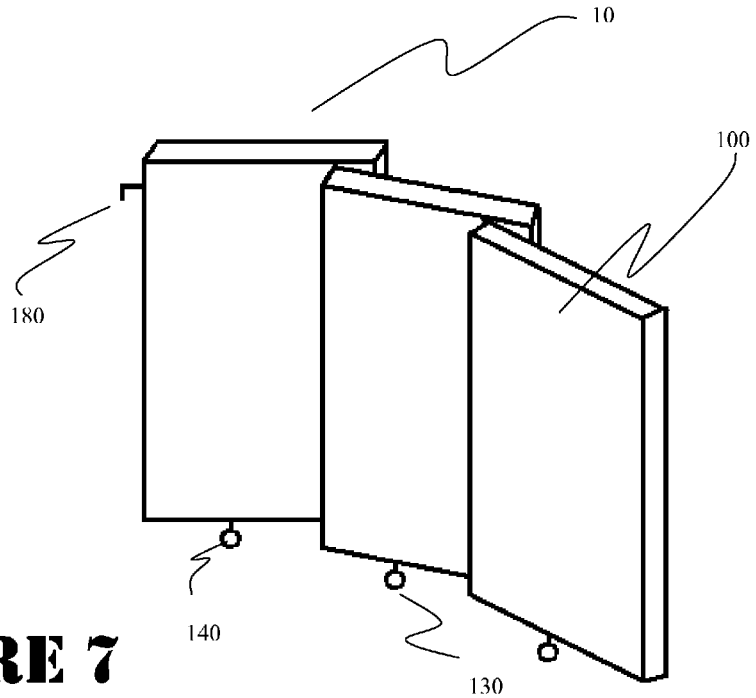
FIG. 7 is a perspective view of a portion of the shielding device; foot piece at the bottom of the rigid planar piece is shown, with detachable wheels.

A hooking mechanism 180 can be built to the left-most and right-most rigid planar pieces 100, as shown in FIG. 5, to allow easy engagement with side walls or other ground structure, for creating a "pie" area generally depicted in FIG. 6A or 6B.

Said mechanism 180 may be made to have fold-in/fold-out feature, as desired.

To facilitate moving the shielding device 10 around, both at time of deployment and storage, foot pieces 130 may be added to the bottom portion of the rigid planar pieces 100. Additionally, detachable wheels 140 may be added to the foot pieces 130, to provide the flexibility of having the wheels 140 on for easy maneuvering and the wheels 140 off for somewhat immobile set up when deployed, as users may choose.

Another preferred embodiment of present invention is to have the serially connected rigid planar pieces form a small overlapping segment OLS, as limited by a travel limiter means 770 built to the track formation 350.

Figure 14A:
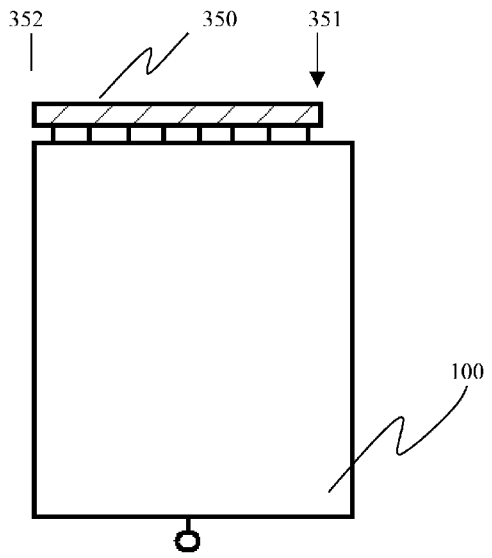
FIG. 14A shows the side (lateral) view of a rigid planar piece with track formation on top, taking up a lateral length shorter than the full lateral length of the rigid planar piece.

In the embodiment with travel limiter means 770, the track formation 350 will have a lateral length that is somewhat shorter than full lateral length of the rigid planar pieces 100, as shown in FIG. 14A.

Figure 14C:
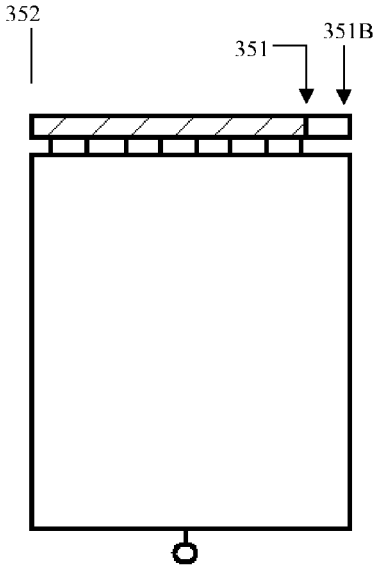
FIG. 14C shows the track formation having same lateral length as the rigid planar piece.
Figure 14B:
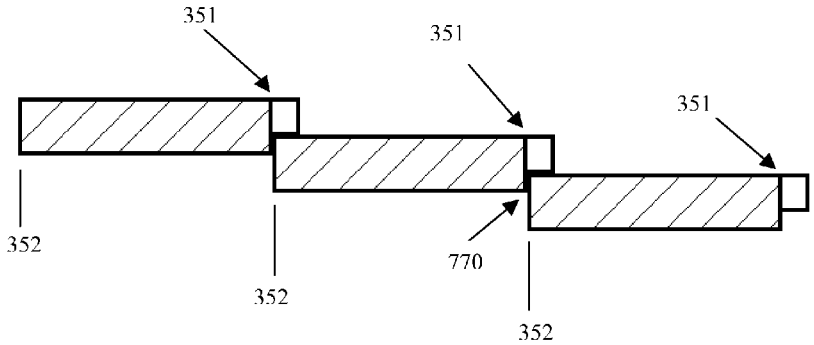
FIG. 14B is s top-down view of two drawn out adjacent rigid planar pieces, with a small overlapping segment.

Note that in actual implementation, said track formation 350 may have the same lateral length as the rigid planar piece 100 attached to, as shown in FIG. 14 C. However, the effective travel between two track pieces will be limited to the point where the left track-edge 352 (on one rigid planar piece 100) will be engaged to the right track-edge 351 (or a corresponding connected rigid planar piece 100), thanks to the use of travel limiter means 770, consequently, only the portion of the "travelled" length between 351/352 would be considered meaningful lateral length of said track formation 350, for purpose of the disclosure herein.

As shown in FIG. 14A, a left track-edge 352 will be at the same lateral location of the left edge of a rigid planar piece 100; a right track-edge 351 will be at a small indent point to the right edge of a rigid planar piece 100. As such, the travel limiter means 770 will cause the left track-edge 352 on one rigid planar piece 100 to be engaged to the right track-edge 351 of a slidably connected rigid planar piece 100, and creating a small overlapping segment O.L.S., as shown in the top-down view presented in FIG. 14B.

Figure 13A:
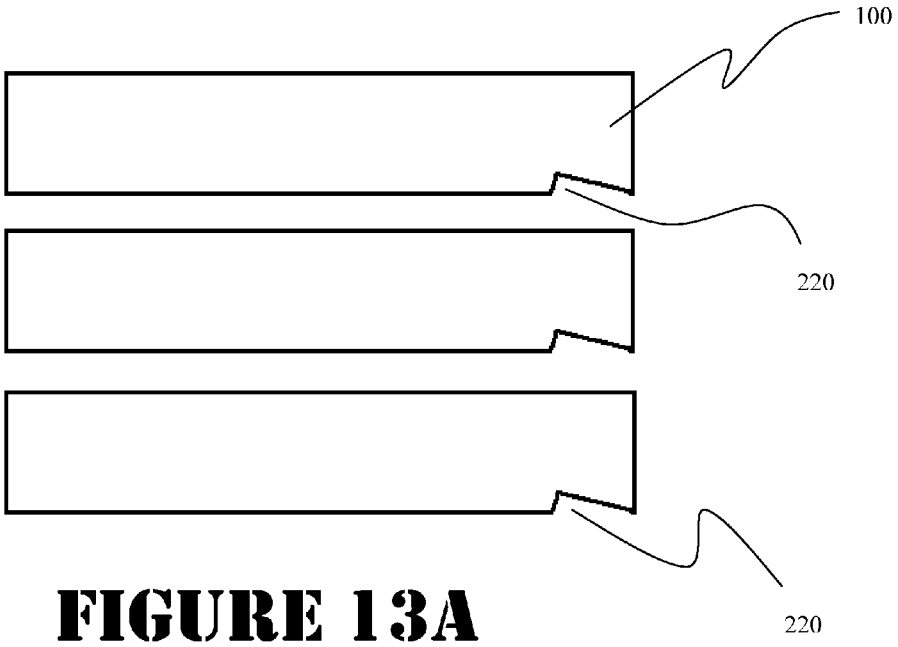
FIG. 13A is a top-down view of the rigid planar pieces in a folded up state, with the inset angled notches shown.
Figure 13B:
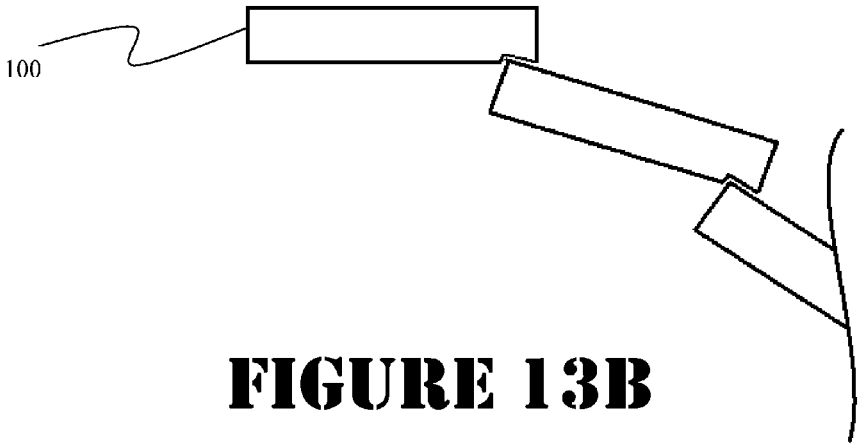
FIG. 13B is a top-down view of the rigid planar pieces in a deployed state, with two adjacent rigid planar pieces joined in the inset angled notches.

To form a small angle in the O.L.S area, the left end of a rigid planar piece 100 will fit into an inset angle notch 220 on the right end of a connected rigid planar piece 199, as shown in FIGS. 13A and 13B.

In the case of an overlapping track formation 300, the travel limiter means 770 is implemented by matching stopper blocks 310 that are added to the end of said overlapping track formation 300, so as to stop the lateral movement of two adjacent rigid planar pieces 100 relative to each other, when the right track-edge 351 of one rigid planar piece 100 is connected to the location of the left track-edge 352 of an adjacent rigid planar piece.

Figure 17:
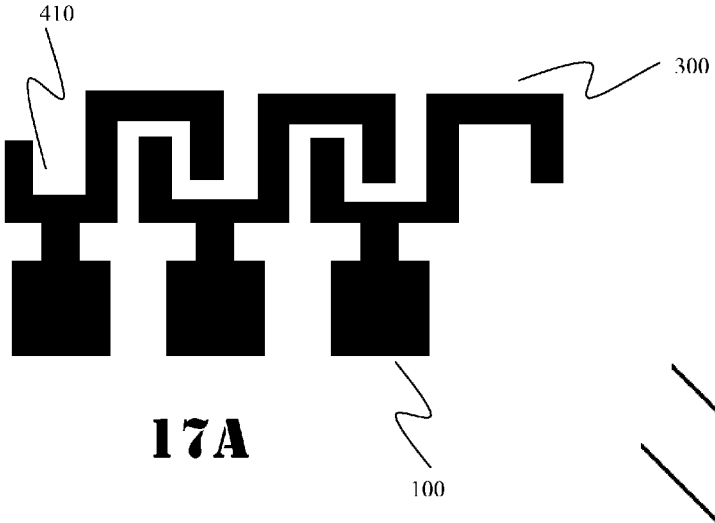
FIGS. 17 A/B/C/D show the travel limiter means of an overlapping track formation.
Figure 17:
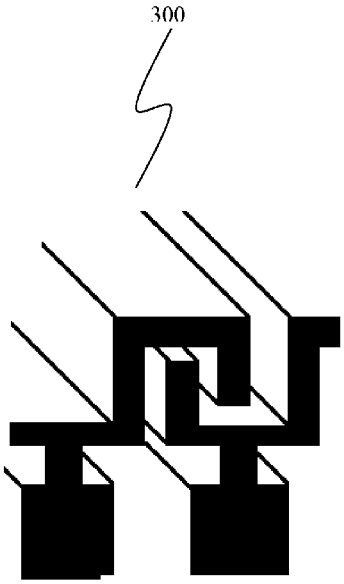
Figure 17:
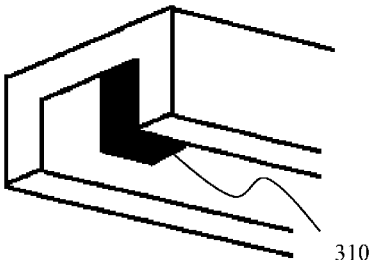
Figure 17:
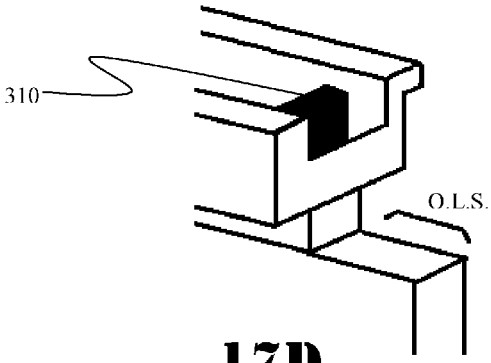

FIGS. 17 C/D show the addition of the stopper blocks 310 on the two respective overlapping track 300 structures, with the simplified overlapping structure shown in FIGS. 17A/B.

In the case of a C-track formation 400, the travel limiter means 770 is implemented by a stopper peg 410 added to the end of an inside track 405, and a close-end block 411 added to the (matching) end of the outside loop 406.

Figure 16A:
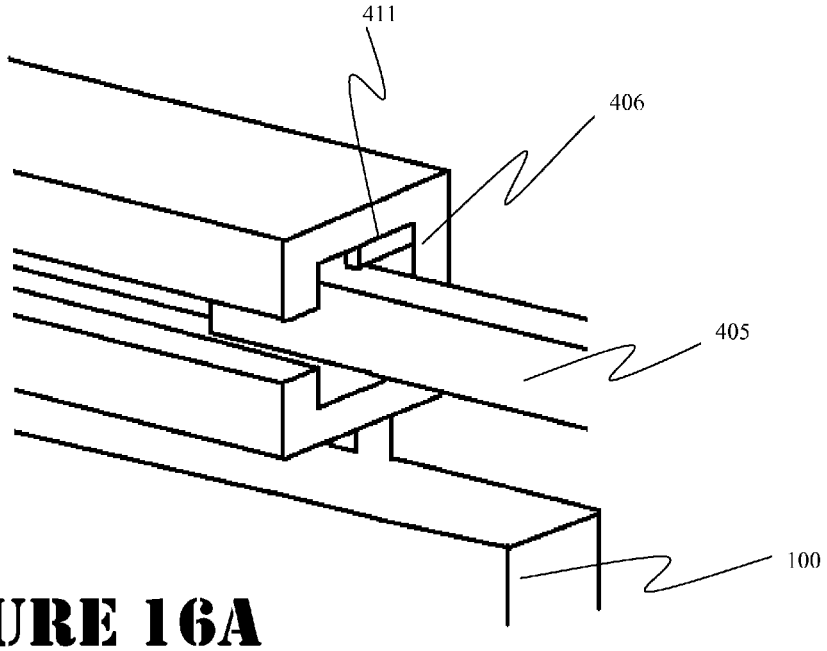
FIGS. 16A-2 and 16B-2 add back the inter-connection between two adjacent rigid planar pieces with the loop fitting pieces in place.
Figure 16B:
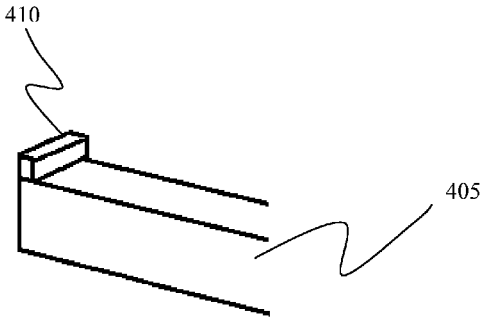

For ease of understanding the function and structure of said stopper peg 410 and close-end block 411, FIGS. 16A and 16B show the simplified view of travel limiter means 770 in the C-track formation 400, by not showing the loop fitting piece 560 and the connection between two adjacent rigid planar pieces.

Figures 2, 16A:
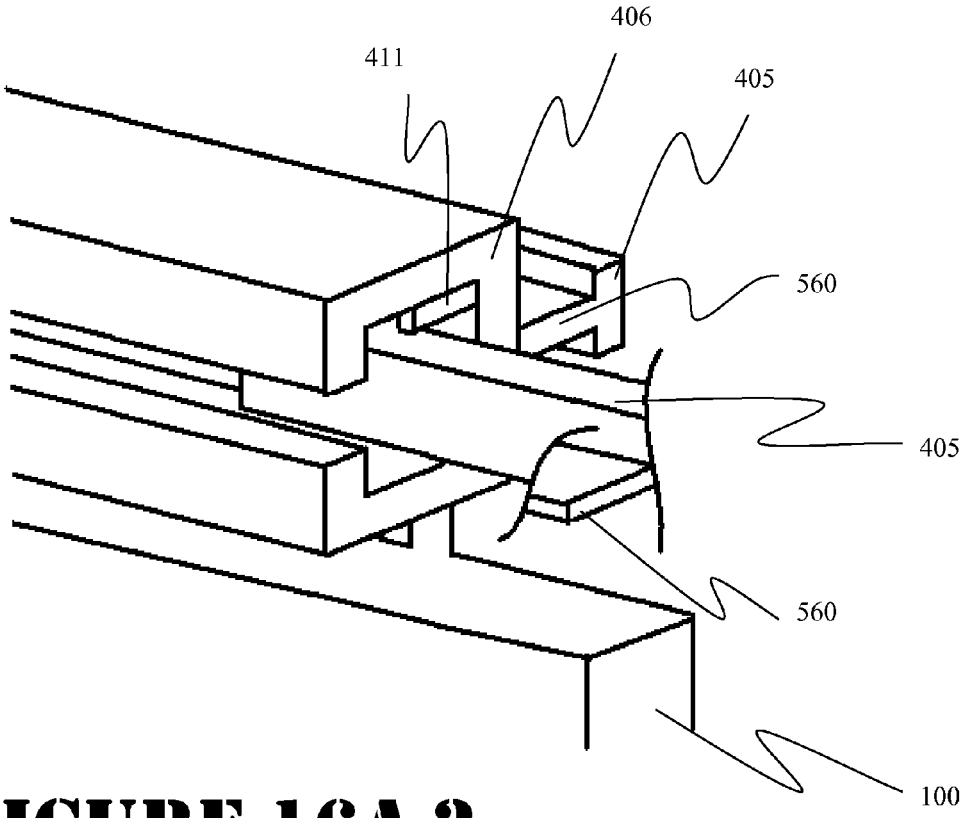
Figures 2, 16B:
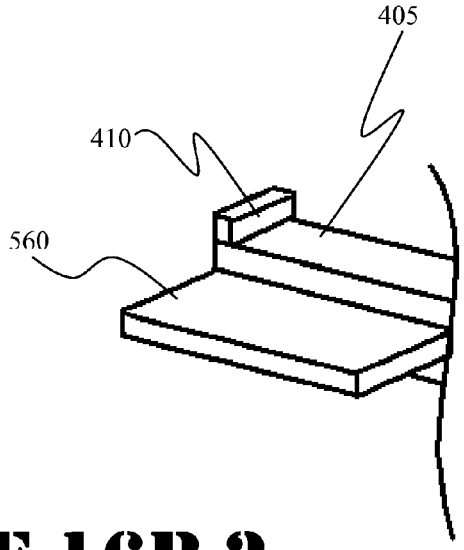

FIGS. 16A-2 and 16B-2 added the loop fitting piece 560, as well as the connection between rigid planar pieces by the slidable C-Track formation.

Another embodiment of the shielding device 10 would be to have every two adjacent rigid planar pieces 100 connected, by the track formation described herein, at their respective left and right end points when drawn out, without a small overlapping segment, as shown in FIG. 6B. To the extent the rigid planar pieces 100 are connected via the track formation 350, either the overlapping track formation 300 or the C track formation 400, the connecting point on the track formation (300/400) would be the left track edge 351 on one piece 100 the alternative right track edge 351B of another rigid planar piece 100; referencing FIG. 14C for such points of connection.

Such an end-to-end connection between every two adjacent rigid planar pieces can be achieved by a travel limited means 770 on the track formation 350, as discussed later.

Though this embodiment can also form a "pie" area, there is no bow-like tensioning force to the overall deployed shielding device, due to the lack of the O.L.S. area.

With hooking mechanisms 180 and the left-most and right-most rigid planar pieces, when drawn out, engaging to two side structures (two side walls flanking at 90 degrees, for example), such a simplified embodiment can also be chosen to fit the design with reduced cost allocation.

Figure 15A:
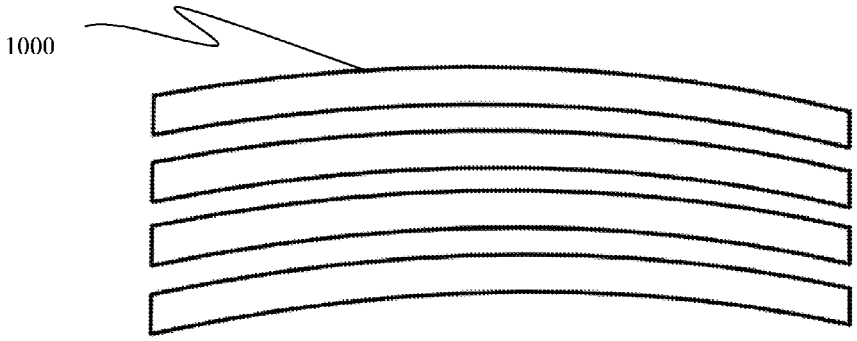
FIG. 15A is a top-down view of the slightly arc-shaped rigid planar pieces in a folded up stated.

In addition to utilizing straight rigid planar pieces to for an "arc" screen by drawing out the connected pieces, the overall "arc" screen can also be formed by having individual slightly arced rigid planar pieces 1000 that are slightly arc-shaped, as shown in FIG. 15A, which denotes the shielding device 10 in its 'stored' state.

Figure 15B:
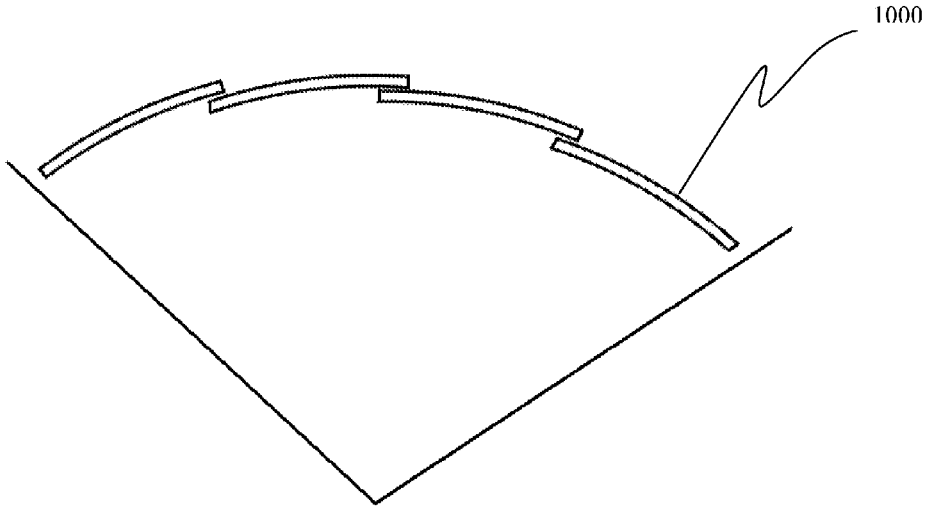
FIG. 15B is a top-down view of the slightly arc-shaped rigid planar pieces in a deployed stated.
Figure 15C:
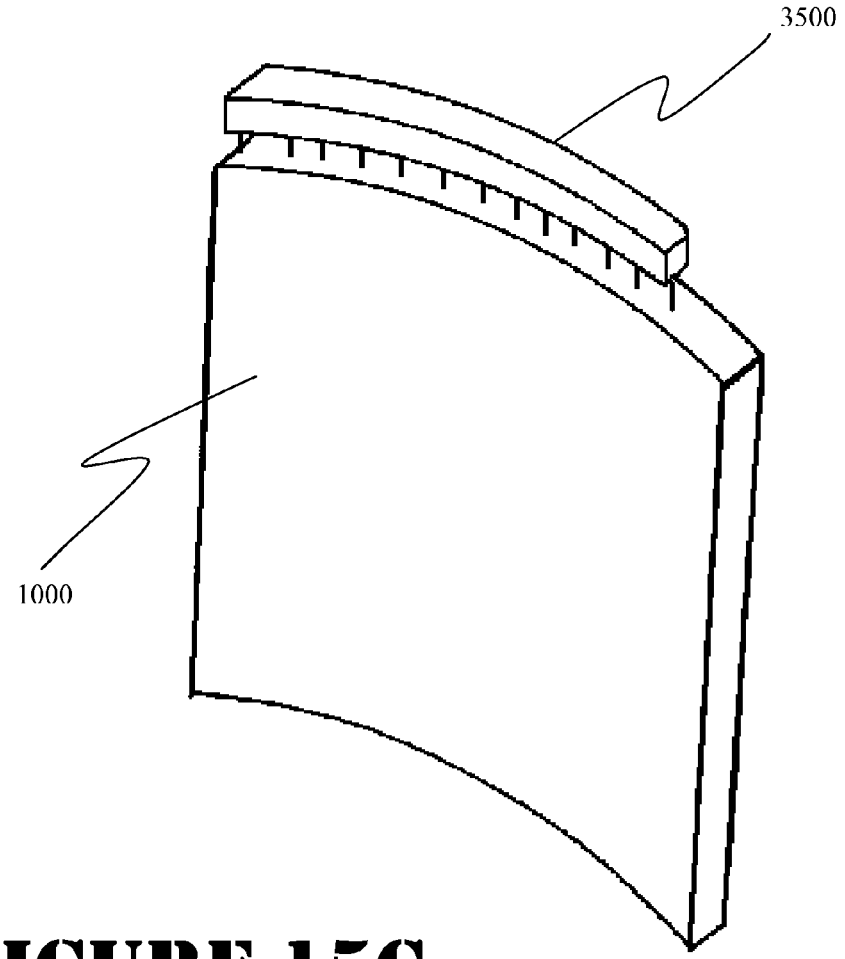
FIG. 15C shows the perspective view of an arc-shaped rigid planar piece.

In such arc-shaped configuration, there will be similar arced track formation 3500 that runs the same lateral length as the lateral length of main rigid planar piece 1000, as shown in FIG. 15C.

With the same travel limited means 770 built in to such arc-shaped configuration, there will be a small overlapping segment O.L.S. between every two adjacent rigid planar pieces 1000 that are still bound by the generally parallel (albeit a bit arc-shaped) track formation 3500, to provide a bow-like tensioning force. See FIG. 15B.

Figure 10:
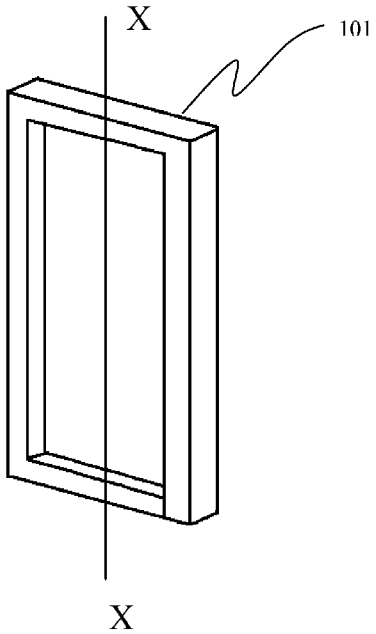
FIG. 10 shows the rigid planar piece may be formed by a rigid frame with sturdy flexible fabric-like material filling in the central opening. X-X denotes a cut line for cross sectional view.
Figure 12:
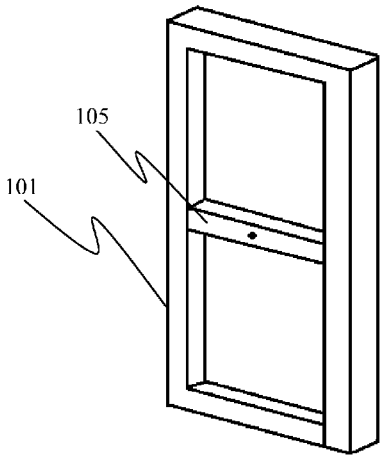
FIG. 12 shows the rigid frame having an optional frame center row.

As an alternative way of implementing shielding function of present invention, the rigid planar pieces 100 may be formed by a rigid frame 101 conforming to the desired outside shape of said rigid planar piece 100, as shown in FIG. 10.

For the center opening area, suitable fabric-like materials 109 that has the desired flexible yet sturdy attribute can be cut and fixed to said rigid frame 101, achieving the creation of a protective surface that consists of "screen" type material.

The optional use of the sturdy fabric-like material 109, one or more layers, to create rigid planar piece 100 has the advantages of reducing overall weight and also increasing the impact resistance from projectiles/bullets, due to the inherent "wiggle" nature.

Figure 11:
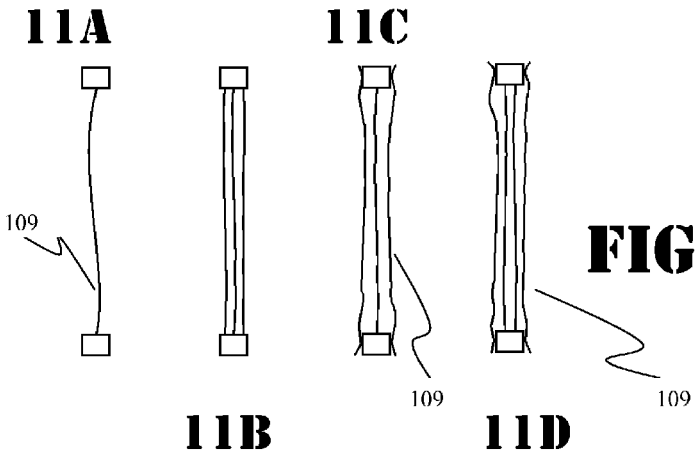
FIGS. 11 A/B/C/D show the X-X cross-sectional view of a rigid frame, having sturdy flexible fabric-material in one or multiple layers.

One or more layers of said sturdy flexible fabric-like material 109 can be fixed to said frame 101, as shown in FIGS. 11A/B/C/D.

Alternatively, a rigid frame 101 may have a frame center row 105, so as to accommodate said pop out ball structure 190, corresponding receiving cavity 110, protrusion mechanism 130 and engaging said protrusion mechanism 130, for the purpose of clicking two adjacent rigid planar pieces 100 in place with small overlapping segment and creating a small angle between two adjacent rigid planar pieces 100.

For the slightly arc-shaped rigid planar pieces 1000, the aforesaid construction of employing sturdy and flexible fabric-like material to fit over a rigid frame 101 is equally applicable and requires no more disclosure, as long as the rigid frame 101 and corresponding structure, such as the frame center row 105, is made to the intended curvature.

What is claimed is:

1. A shielding device, comprising:

a. a plurality of rigid planar pieces slidably connected together in a seriatim manner;

b. a pop-out ball structure and a corresponding receiving cavity on two adjacent said rigid planar pieces respectively, so that when two adjacent rigid planar pieces are moved laterally to form a drawn out extended screen shape, said ball structure on one rigid planar piece will click into the corresponding receiving cavity on the adjacent rigid planar piece to stop further lateral movement, having a small overlapping segment between two adjacent rigid planar pieces; and, c. a protrusion actuated by the clicking-in of said pop-out ball structure to the corresponding receiving cavity, resulting in the intended protrusion from one rigid planar piece to push away the adjacent rigid planar piece and creating a small angle between the two adjacent rigid planar pieces, wherein said protrusion is a pivoting rod.

2. The shielding device of claim 1, wherein the slidable connection is made at the top or bottom of said rigid planar pieces.

3. A shielding device, comprising:

a. a plurality of rigid planar pieces slidably connected together in a seriatim manner;

b. a pop-out ball structure and a corresponding receiving cavity on two adjacent said rigid planar pieces respectively, so that when two adjacent rigid planar pieces are moved laterally to form a drawn out extended screen shape, said ball structure on one rigid planar piece will click into the corresponding receiving cavity on the adjacent rigid planar piece to stop further lateral movement, having a small overlapping segment between two adjacent rigid planar pieces; and, c. a protrusion actuated by the clicking-in of said pop-out ball structure to the corresponding receiving cavity, resulting in the intended protrusion from one rigid planar piece to push away the adjacent rigid planar piece and creating a small angle between the two adjacent rigid planar pieces, hooking mechanisms on the left-most and right-most rigid planar pieces.

4. A shielding device, comprising:

a. a plurality of rigid planar pieces slidably connected together in a seriatim manner;

b. a pop-out ball structure and a corresponding receiving cavity on two adjacent said rigid planar pieces respectively, so that when two adjacent rigid planar pieces are moved laterally to form a drawn out extended screen shape, said ball structure on one rigid planar piece will click into the corresponding receiving cavity on the adjacent rigid planar piece to stop further lateral movement, having a small overlapping segment between two adjacent rigid planar pieces; and, c. a protrusion actuated by the clicking-in of said pop-out ball structure to the corresponding receiving cavity, resulting in the intended protrusion from one rigid planar piece to push away the adjacent rigid planar piece and creating a small angle between the two adjacent rigid planar pieces; and foot pieces that have detachable wheels, so as to facilitate moving around on the ground either in the fold-up state or deployed state.

5. A shielding device, comprising:

a. a plurality of rigid planar pieces slidably connected together in a seriatim manner;

b. a pop-out ball structure and a corresponding receiving cavity on two adjacent said rigid planar pieces respectively, so that when two adjacent rigid planar pieces are moved laterally to form a drawn out extended screen shape, said ball structure on one rigid planar piece will click into the corresponding receiving cavity on the adjacent rigid planar piece to stop further lateral movement, having a small overlapping segment between two adjacent rigid planar pieces; and, c. a protrusion actuated by the clicking-in of said pop-out ball structure to the corresponding receiving cavity, resulting in the intended protrusion from one rigid planar piece to push away the adjacent rigid planar piece and creating a small angle between the two adjacent rigid planar pieces, wherein said plurality of rigid planar pieces are formed by a rigid frame with at least one layer of sturdy flexible fabric-like material fixed to said rigid frame.

* * * * *